US005611269A

United States Patent [19]

Bielfeldt

[11] Patent Number: 5,611,269

[45] Date of Patent: Mar. 18, 1997

[54] CONTINUOUSLY OPERATING PRESS FOR THE PRODUCTION OF PARTICLE BOARDS, FIBER BOARDS OR SIMILAR WOOD BOARDS AND PLASTIC BOARDS

[75] Inventor: Friedrich B. Bielfeldt, Pähl, Germany

[73] Assignee: Maschinenfabrik J. Dieffenbacher GmbH & Co., Eppingen, Germany

[21] Appl. No.: 390,979

[22] Filed: Feb. 21, 1995

[30] Foreign Application Priority Data

Feb. 19, 1994 [DE] Germany ..... 44 05 343.6

[51] Int. Cl.[6] ..... B30B 15/34; B30B 5/06

[52] U.S. Cl. ..... 100/311; 100/154; 100/211; 100/295; 100/325; 156/583.5; 425/371

[58] Field of Search ..... 100/93 P, 93 RP, 100/151, 154, 211, 295; 156/583.3, 583.5; 425/371

[56] References Cited

U.S. PATENT DOCUMENTS

| | | | |
|---|---|---|---|
| 298,848 | 5/1884 | Hamilton | 100/93 P |
| 373,473 | 11/1887 | Moss et al. | 100/93 P |
| 2,542,901 | 2/1951 | Chaffee | 100/93 RP |
| 2,863,491 | 12/1958 | Adams, Jr. | 100/93 P |
| 3,007,427 | 11/1961 | Bryan et al. | 100/93 P |
| 3,190,051 | 6/1965 | Souligney | 100/93 P |
| 3,277,814 | 10/1966 | Malm et al. | 100/295 |
| 3,851,685 | 12/1974 | Ahrweiler et al. | 100/154 |
| 3,965,769 | 6/1976 | Ahrweiler et al. | 100/151 |
| 3,993,426 | 11/1976 | Ahrweiler et al. | 425/371 |
| 4,468,188 | 8/1984 | Gerhardt | 425/371 |
| 5,112,431 | 5/1992 | Gerhardt et al. | 156/583.5 |
| 5,253,571 | 10/1993 | Bielfeldt et al. | 100/41 |
| 5,259,752 | 11/1993 | Scolamiero et al. | 100/211 |
| 5,323,696 | 6/1994 | Bielfeldt et al. | 100/154 |
| 5,333,541 | 8/1994 | Bielfeldt et al. | 100/41 |

FOREIGN PATENT DOCUMENTS

| | | | |
|---|---|---|---|
| 2545366 | 4/1977 | Germany . | |
| 7525935 | 4/1980 | Germany . | |
| 3133817 | 3/1983 | Germany . | |
| 3914105 | 10/1990 | Germany . | |
| 4201193 | 12/1992 | Germany | 425/371 |
| 559 | of 1895 | United Kingdom | 100/295 |

*Primary Examiner*—Stephen F. Gerrity
*Attorney, Agent, or Firm*—Foley & Lardner

[57] ABSTRACT

A fluted or honeycombed profile on the rear side of the pressing stock or rolling side of the heating/press platens, which profile enables an increased flexible, two-dimensional deformation, in a longitudinally and transversely controlled manner, in just a few seconds in the on-line control process while providing larger support spacings. The fluted profile along the whole of the pressing zone advantageously increases the elastic bending deformability in the transverse direction, while, as a result of the honeycombed profile, an increased flexibility longitudinally to the pressing zone is attained. As a result of the fluted profile longitudinally to the pressing zone, the two-dimensional, spherical flexibility of the press/heating platen is substantially increased, so that use is preferably made of this fluted profiling. The honeycombed profiling additionally increases the longitudinal deformation in the press/heating platens transversely, so that its introduction is, for the most part, only partially necessary where there are elevated requirements.

17 Claims, 5 Drawing Sheets

CONTINUOUSLY OPERATING PRESS FOR THE PRODUCTION OF PARTICLE BOARDS, FIBER BOARDS OR SIMILAR WOOD BOARDS AND PLASTIC BOARDS

BACKGROUND OF THE INVENTION

The invention relates to a press/heating platen for continuously operating presses for the production of particle boards, fiber boards or similar wood boards and plastic boards.

Various designs of press/heating platens are used in continuously operating presses according to German Offenlegungsschrift/Patent Specification 21 57 746, 25 45 366, 31 33 817, 39 14 105, 40 17 791 and German Utility Model 75 25 935.

In the prior art, in order to control the procedure, all continuously operating presses must accurately reproduce the process sequence, as known from the intermittent-operation press technology for the production of particle boards, MDF (Medium Density Fiber) boards or OS (Oriented Strand) boards. The procedure for the pressing force action and degasification time upon the pressing stock is essentially executed by longitudinal deformation along the pressing zone. In continuously operating presses, the spherical deformation occurring transversely to the pressing zone is additionally necessary. Therefore, at least one of the two press/heating platens must be deformable between flatness (primarily in the calibration area in the exit region of the pressing zone, the low-pressure area) and a convex geometry (primarily in the entry region of the pressing zone, high-pressure and central medium-pressure area). The amount of deformation also depends upon the board thickness of the pressing stock, the bulk density and the moisture content of the particle/fiber/pressing stock. It is also important to be able to set the minimum possible pressing factor (the maximum possible steel-belt production speed) where optimal physical process requirements are placed upon the pressing stock itself, such as transverse tensile strength and bending strength. It is necessary along the pressing zone, longitudinally and transversely, to be able to set different nip clearances between the upper and lower press/heating platen, and be precise with the following nip clearance differences: longitudinal deformability (Delta I) about 0 to 3 millimeters per meter and transverse deformation (Delta q) about 0 to 1 millimeter per meter.

According to the continuously operating presses which are currently available, the press/heating platens used are deformed either one-dimensionally or two-dimensionally. The continuously operating presses hitherto constructed by the applicant according to German Offenlegungsschrift 40 17 791 operate on the principle of a top-piston press, according to which the deformability of the press/heating platens is brought about in the following manner. The longitudinal deformation is effected one-dimensionally at the upper press/heating platen, which is connected non-positively to the flexibly controllable press beam system and controlled by means of the lateral, upper press pistons. The transverse deformation is effected two-dimensionally with the lower press/heating platen by means of the multi-pot short-stroke cylinders.

According to the continuously operating press disclosed in German Patent Specification 31 33 817 and German Patent Specification 39 14 105, the spherical action upon the pressing stock is effected two-dimensionally with the upper press/heating platen. The longitudinal deformation is effected by the hydraulic actuator rows in each press frame along the pressing zone. The deformability is systematically restricted, due to the slab (having a counter-heating system), and by the higher inherent stiffness. The transverse deformation is herein effected essentially by the counter-heating in the slab. The counter-heating temperatures can be set differently along the pressing zone; e.g., in the front region, in order to give a stronger convex deformation, lower counter-heating temperatures are employed relative to the press/heating platen temperature. By contrast, in the exiting low-pressure region of the pressing zone, in order to obtain the necessary flatness tendency, the counter-heating temperatures are set higher. The convex bending deformation is additionally supported at each press frame by minimizing the hydraulic actuating forces of the outer cylinders of the actuator row. However, this is only possible to a limited degree, since the slab system possesses high inherent stiffness. By virtue of the fact that the entire system operates relatively sluggishly in terms of controllability transverse to the direction of transport of the pressing stock, an on-line adjustment in economic fashion is not possible in just a few seconds.

In continuously operating presses having bottom-piston systems, as in German Offenlegungsschrift 21 57 746, German Offenlegungsschrift 25 45 366 and German Utility Model 75 25 935, the lower press/heating platen, as in the previously described top-piston system, is deformed two-dimensionally. The press/heating platen is of relatively thin and consequently very flexible construction. The lesser press/heating platen thickness dictates very narrow support spacings of the cylinder-piston arrangements. This design however, as a result of the multiple cylinder-piston arrangements and the increased number of actuator rows, is complex in production engineering terms and also very expensive.

The drawbacks of the previous top and bottom-piston systems and the resulting problems they experience are as follows.

The two-dimensional deformation of a press/heating platen has, for a given press/heating platen thickness, a lesser flexibility relative to the one-dimensional deformation. In accordance with the previously mentioned requirement profile, this flexibility is about a third less, due to the additional buckling stresses which are generated during the two-dimensional deformation.

In order to get around this drawback, a dual-function system, an expensive system in design terms, such as the top-piston press according to German Offenlegungsschrift 40 17 791, can be used. A higher flexibility in respect of a two-dimensional deformation can be achieved, as in the continuously operating presses described in German Offenlegungsschrift/Patent Specification 21 57 746, 25 45 366, 31 33 817, 39 14 105 and German Utility Model 75 25 935, with very small support spacings, since the heating/press platen can be designed to be relatively thin and hence highly flexible. However, apart from the additional complexity in machine construction, a further expense is incurred for the additional control requirement of the large number of hydraulic actuators.

Larger support spacings, for example along the pressing zone, lead to thicker heating/press platens. Otherwise, thinner heating platens again have to be used as a result of other design concerns, for instance a supporting slab having counter-heating, thereby giving rise, once again, to the described production-engineering drawbacks.

SUMMARY OF THE INVENTION

One object of the invention is to provide heating/press platens for continuously operating presses for the production of wood boards and plastic boards, which, while avoiding the described drawbacks associated with two-dimensional deformation (longitudinally and transversely to the transport of the pressing stock), achieve elastic deformation values with the following predefined objectives:

In the case of thick press/heating platens having larger support spacing, the aim is to attain spherical deformation values which are comparable with thinner press/heating platens having smaller support spacings, and to obtain deformation values not only equal to those attainable in respect of one-dimensional deformability, but also higher flexible deformation values; so that, with the use of a small number of hydraulic actuators, combined with larger support spacings, the technological requirements for the setting of different nip clearances longitudinally and transversely to the pressing zone can be achieved with lower production costs.

The above and the other objects of the invention are accomplished with a press/heating platen for continuously operating presses in the production of particle boards, fiber boards or similar wood boards and plastic boards, having flexible endless steel belts which transmit the pressing pressure, pull the material to be pressed through the press, are guided via driving drums and reversing drums around an upper and a lower press beam and are supported with an adjustable press nip against the press/heating platens on the press beams via rolling supporting elements which accompany their revolution and are guided with their axes transverse to the running direction of the belt, the lower and/or the upper press/heating platen, for the setting of the press nip, being vertically adjustable by means of a plurality of cylinder-piston arrangements disposed in rows longitudinally and transversely to the longitudinal axis of the press, wherein into the rear sides of the press/heating platens, longitudinally to the pressing zone between the actuator rows, there are molded fluted grooves and, in addition, transversely to the pressing zone between the actuator rows, honeycombed grooves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

Further features and advantages of the invention derive from the following description of an illustrative embodiment with reference to the drawings, in which.

DETAILED DESCRIPTION OF THE PREFERRED EMBODIMENTS

Figure 1:
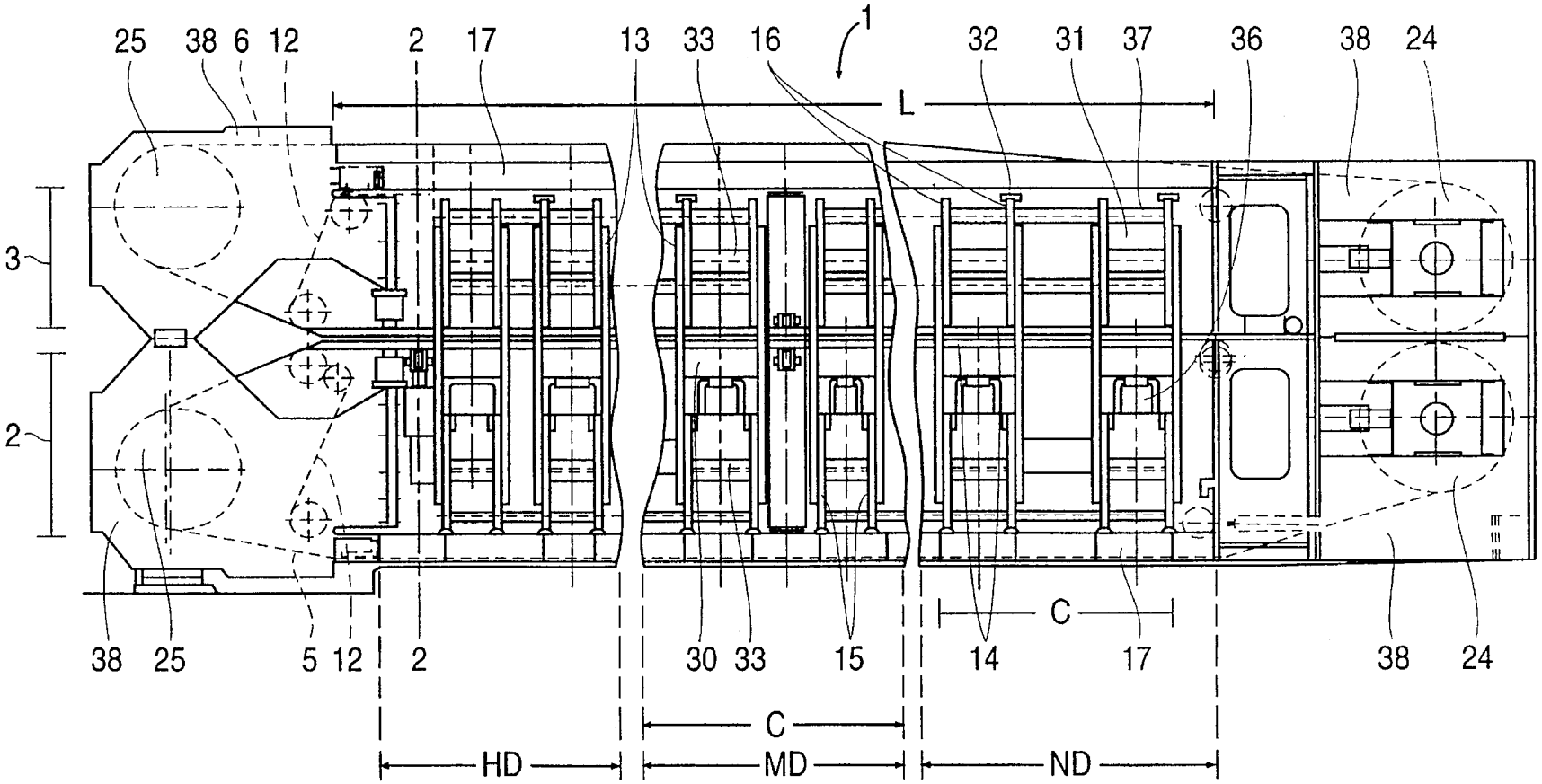
FIG. 1 is a side view of a continuously operating press for the press/heating platen according to the invention.
Figure 2:
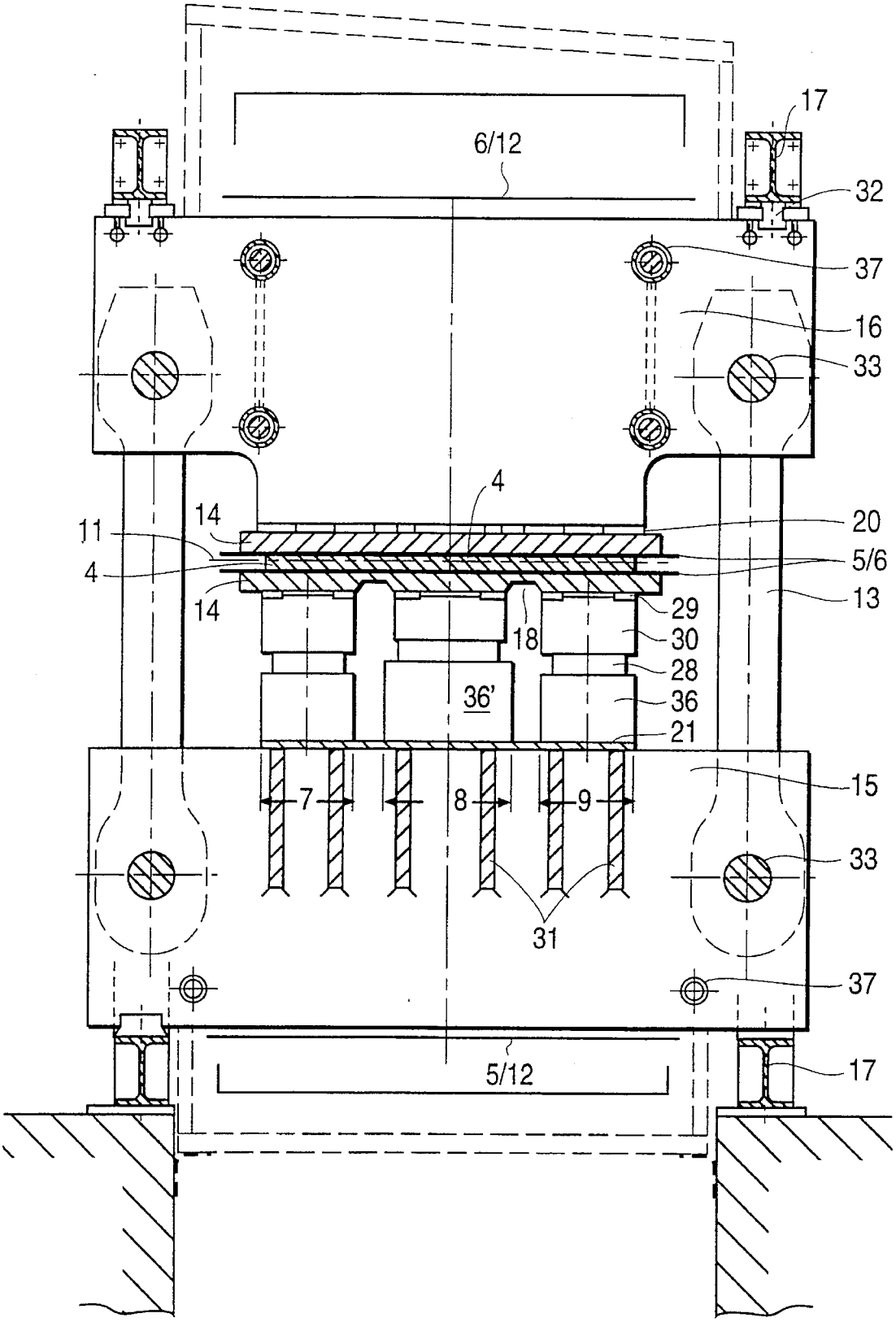
FIG. 2 is a front view of the continuously operating press according to FIG. 1 along section 2—2.
Figure 3:
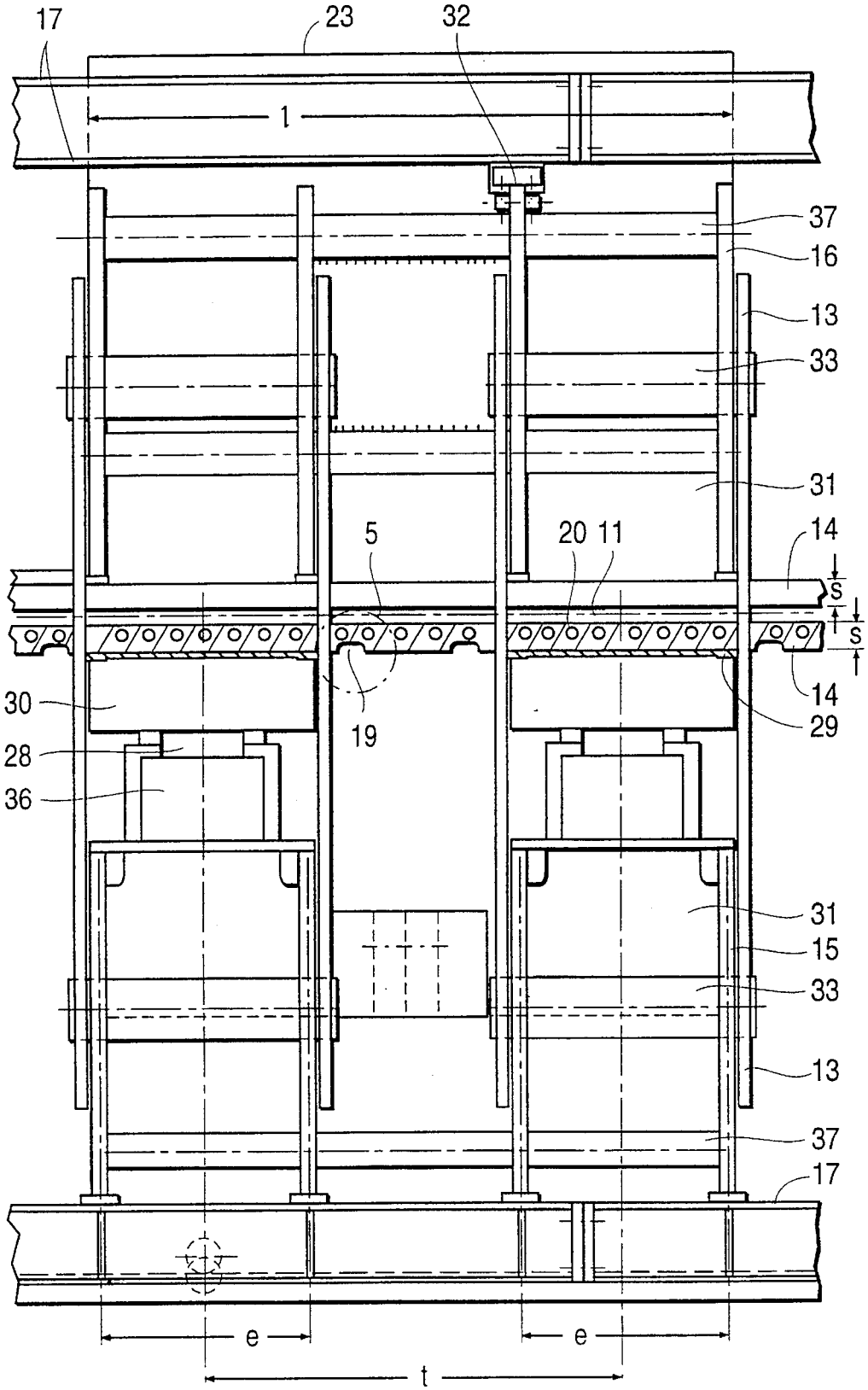
FIG. 3 is a detailed illustration indicated as 3 in FIG. 1.

Press/heating platens 14 according to the invention are used in continuously operating presses, as represented in FIGS. 1 to 3. Such a continuously operating press 1 according to the invention comprises, in its principal parts, upper and lower press beams 3 and 2 and tiebars 13 which positively connect them. The tiebars 13 can be quickly released by means of push-in pins 33. To the end faces of the press beams 2 and 3, there are fitted side plates 38, serving as an anchor and bearing point for driving drums 24, reversing drums 25 and entry systems for rolling rods 12. The press beams 2 and 3 solely comprise web plates 15 and 16 and ribs 31 which connect these. Four web plates, indicated as 15 and 16, are connected by means of tie rods 37 to form an individual beam 23, which tie rods represent, by virtue of the lining-up and fitting of the press/heating platens 14, the length L of the press beams 2 and 3.

From FIG. 1 it can further be seen how the reversing drums 25 form the entry nip and how the rolling rods 12, which are guided with steel belts 5 and 6 around the press beams 2 and 3, are supported against the press/heating platens 14, i.e., the revolving rolling rods 12, as an example of a rolling support, are disposed, such that they roll along, between the press/heating platens 14 and the steel belts 5 and 6. The pressing stock 4 is pulled, with the steel belts 5 and 6 driven by the driving drums 24, through the press nip 11 and pressed into boards.

The pretensioning forces of the steel belts 5 and 6 between the entry and exit drum systems are absorbed as compressive force by four I-section girders 17. The two lower I-section girders 17 are anchored in the foundation and support the lower press beam 2. The web plate construction of the press beam 3 can be suspended by means of screw joints 32 from the upper I-section girders 17.

In the hydraulic cylinder-piston arrangements 7, 8 and 9, also denoted as an actuator row m transverse to the longitudinal axis of the press 1 (see FIG. 4), pressure pistons 28 are disposed beneath the press/heating platen 14 and are supported on supporting plates 21 of the lower press beam 2. They could equally be used as top pistons below the upper press beam 3. For thermal reasons, however, the bottom-piston arrangement is preferred so as to minimize heating of the hydraulic oil by the rising heat. In order to enable spherical deformation in the transverse direction, for example convex deformation, a higher force is employed in the case of the central cylinders 36' relative to the lateral cylinders 36. This means that a different hydraulic pressure is set relative to the outer cylinders 36. In the case of a preferred convex setting, the central cylinder can be provided with a larger piston area. The cylinders 36 and 36' and the pressure pistons 28 are respectively assigned supporting crossmembers 30, which herein transmit the centrally acting hydraulic forces from the pressure pistons 28 to the supporting crossmembers 30 and, via a plurality of supporting bodies 29, to the lower press/heating platen 14.

The supporting bodies 29 are disposed at the four corner points of the supporting crossmembers 30 in such a way that their support spacings x (see FIG. 4) correspond to support spacings e of the web plates 15 and 16 (see FIG. 3). In the preferred illustrative embodiment according to FIG. 4, for each support spacing e (frame spacing) and supporting crossmember 30, there exist four supporting bodies 29. This would correspond to twelve if, for a normal width k of about 2200 mm, three cylinders 36 were employed transversely across the width of k of the heating platen. In the case of greater widths k, four hydraulic cylinder-piston arrangements 7, 8, 9 and 10 would be employed.

By virtue of the larger range of action of the hydraulic cylinder-piston arrangements 7, 8 and 9 and of the advantageous arrangement of fluted and honeycombed grooves 18 and 19, the geometry of the lower press/heating platen 14 can be controlled hydraulically to give a convex, spherical or concave shape. Each altered geometric position within the longitudinal and transverse deformation can be set in the on-line process in just a few seconds.

As a result of the supporting crossbeam 30, the upper and lower press/heating platens 14 can be made relatively thin, such that the lower press/heating platen 14 can be deformed spherically, both longitudinally and transversely, within the elastically permissible range by hydraulic-mechanical means in accordance with technological requirements. The hydraulic and mechanical structure for influencing the heating platen has thereby been considerably simplified and the number of functional elements substantially minimized, so that a considerable minimization in the cost of the apparatus has been achieved. In order to attain a predetermined pressing-force profile, cylinders with a greater force, i.e., a larger cylinder diameter, are used in the front high-pressure region HP, whilst cylinders 36 with a lower force and a smaller cylinder area are used in the medium-pressure region MP and low-pressure region LP, thus matching the pressing-force profile.

Figure 4:
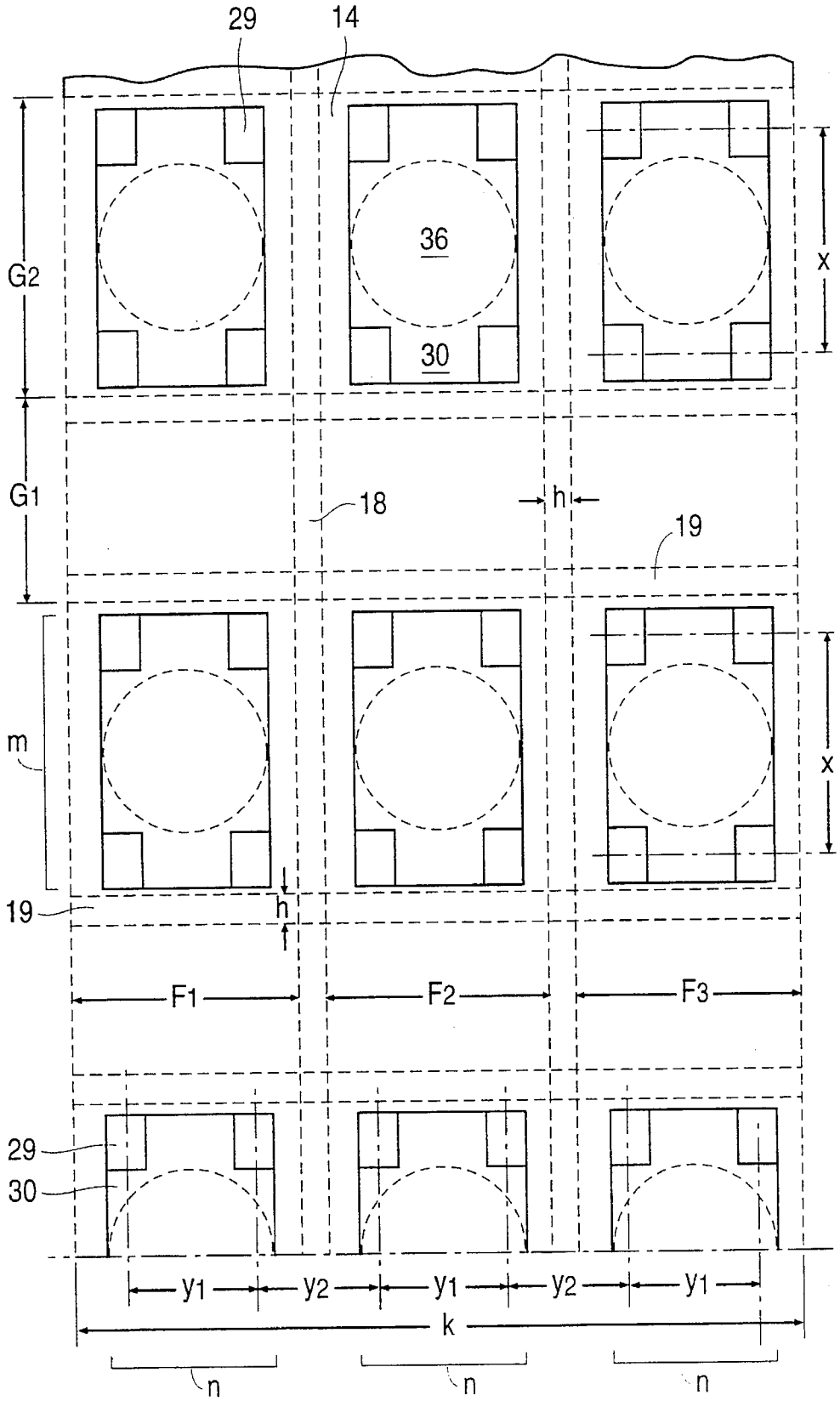
FIG. 4 is a top view of part of the press/heating platen support by the cylinder-piston arrangements, and is a detailed illustration of a portion.

FIG. 4 illustrates a possible arrangement and configuration of three cylinder-piston arrangements 7, 8 and 9 for a heating platen width k of about 2200 millimeters, where t denotes the support spacing of one actuator row m to the next and x denotes the support spacing of the supporting bodies 29 longitudinally to the length L of the press beam. The support spacing y of the supporting bodies 29 is varied but, depending on the dimension of the supporting crossmembers 30, can be equal. As is further apparent from FIG. 4, the supporting bodies 29 always act perpendicularly and congruently on the end faces of the web plates 15, so that the center distance e between two web plates 15 is equal to the center distance x between two supporting bodies 29, i.e., the width of the supporting crossmembers 30 and the arrangement of the supporting bodies 29 thereon changes with the center distance e between the web plates 15.

Different hydraulic forces in the pressure pistons 28 bring about spherical deformation of the press/heating platen 14 with corresponding bending deformations (bending lines) longitudinally and transversely to the pressing zone. By virtue of the non-positive arrangement of the supporting bodies 29, the perpendicular axis of the pressure pistons 28 follows these elastic bending deformations in a spherically oriented angular deviation. Guidance and hydraulic sealing of the pressure pistons 28 are designed with corresponding degrees of freedom in such a way that they automatically follow the variable angular position of the piston.

According to the invention, a plurality of press/heating platens 14 are disposed to line up with a rectangular layout on the bottom side of the press beam 3 and are supported, by means of a plurality of actuator rows m transversely and actuator rows n longitudinally, against the lower press beam 2. In the described continuously operating press 1, there are preferably employed two fluted grooves 18 longitudinally in the case of three actuator rows n, or three fluted grooves 18 longitudinally in the case of four actuator rows n (larger press width k).

Figures 5, 6:
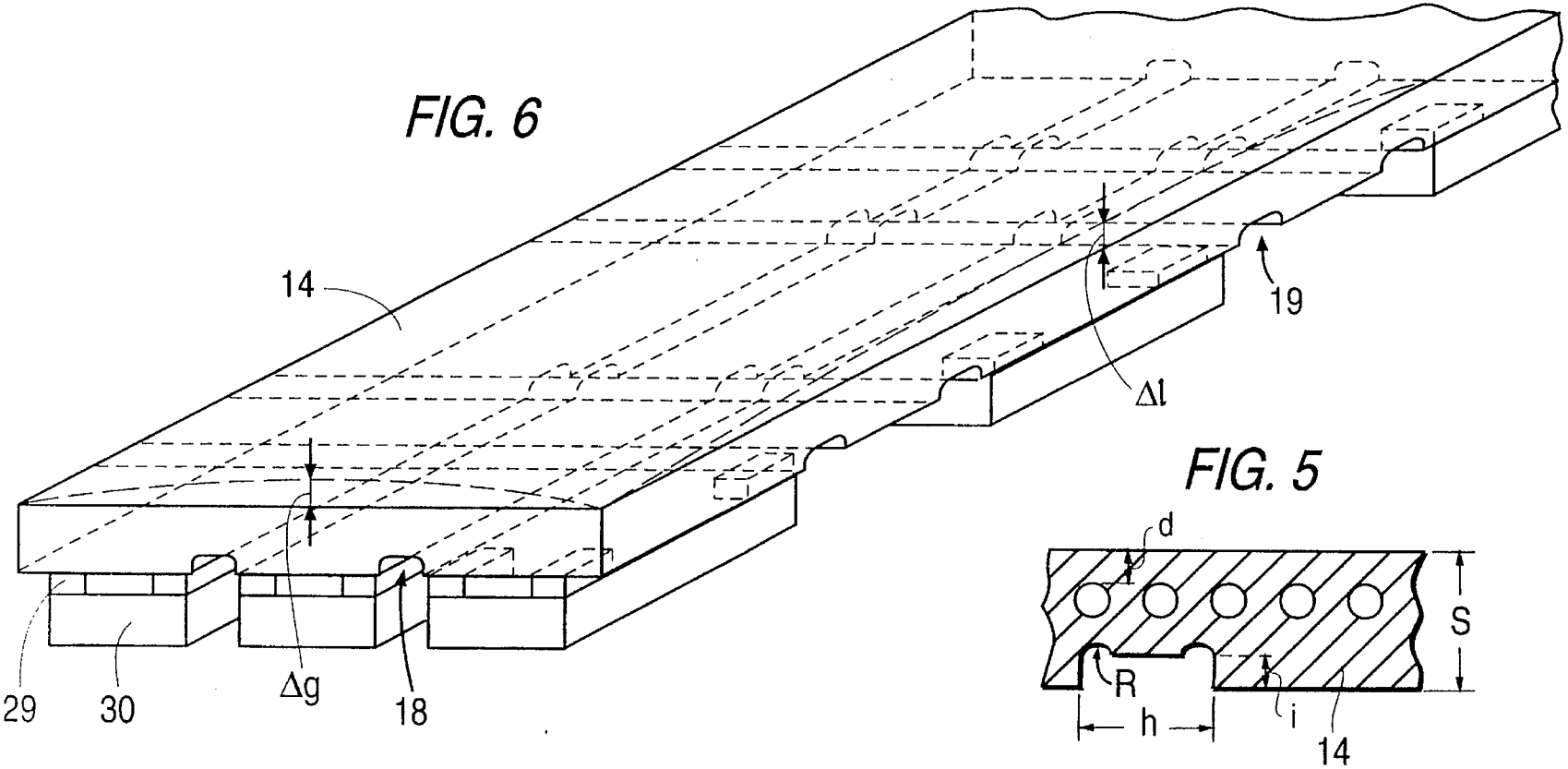
FIG. 5 is a detailed view of the press/heating platen indicated as 5 in FIG. 3.
FIG. 6 is a perspective view of the heating platen according to the invention.

According to FIGS. 2, 4 and 6, the cross section of a press/heating platen 14 is herein divided into three thicker supporting regions F1, F2 and F3. Between them there are disposed the fluted grooves 18, i.e., the fluted grooves 18 lie respectively between two supporting bodies 29 and supporting regions F1, F2 and F3 respectively cover the supporting bodies 29. According to FIGS. 3 and 6, two honeycombed grooves 19 are disposed in such a way in the press/heating platens 14, between the actuator rows m, having a distance G1 therebetween, that they are located adjacent to the supporting bodies 29.

Between the supporting bodies 29, in the segments G1 and G2, there exists a larger cross section in the middle of these segments. Consequently, there exists a lesser sagging, but a higher bending flexibility in the groove region h due to the smaller cross section S1 of the press/heating platen 14.

The fluted and honeycombed groove arrangement 18 and 19 of the press/heating platen 14 is represented in FIG. 6 in relation to the supporting crossmembers 30. To be used for dimensioning the fluted and honeycombed grooves 18 and 19, the thickness s of a press/heating platen 14 is expediently obtained essentially from the support spacing e of the supporting bodies 29 on which the press/heating platen 14 is supported. The fluted or honeycombed groove geometry is herein based upon its immediate arrangement in the proximity of the supporting bodies 29, i.e., upon the permissible notch stresses in the inner groove region and in the compound curve R of the grooves in accordance with the required bending deformations longitudinally (Delta I=three millimeters per meter) and transversely (Delta q=one millimeter per meter), in which case the following values apply:

Groove depth i max. approx. equal to 0.25×press/heating platen thickness s,

Groove width h approx. equal to the press/heating platen thickness s, and

Compound curve R in the grooves 18 and 19 approx. equal to 0.5 to 1×the groove depth i.

The eccentric arrangement of the heating bores 20 is shown in FIG. 5. The heating bores 20, through which heating medium (water, steam, oil) are conveyed, are disposed in the press/heating platen 14 eccentrically in the direction of rolling, i.e., pressing stock side. Justification for this can be found in the fact that, in the continuous production process, a heat transfer takes place from the heating bores 20 in the direction of the pressing stock side. This means that, as a result of the constant release of heat in the direction of the pressing stock 4, a temperature gradient is produced between the rolling (pressing stock) side and the supporting side of the press/heating platens 14. The effect of this is that the press/heating platen wants to undergo concave deformation from thermal contraction, in the direction of the pressing stock side, since it is colder on the pressing stock side. In order to counteract this concave deformation, the heating bores 20 are disposed eccentrically to the pressing stock side. The inner bore distance d from the rolling side is dimensioned to be about 0.2 to 0.35 of the press/heating platen thickness s. A balanced flatness is thereby obtainable, in accordance with the temperature gradient resulting from the press/heating platen thickness s. This regularity advantageously accords with the one-sided arrangement of the fluted or honeycombed grooves 18 and 19 on the supporting side of the press/heating platen 14.

For the convex transverse deformation, the fluted grooves 18 are used along the entire length of the press/heating platens 14, for precise geometric arrangement as previously described. The honeycombed grooves 19 transverse to the press/heating platen 14, by contrast, do not have to be disposed, in accordance with the previously described assignment, along the entire pressing zone, but preferably need to be used only where, in accordance with the process-engineering requirements, greater longitudinal deformations, for example greater than one millimeter per meter, are necessary.

The special assignment of the fluted or honeycombed grooves 18 and 19 in the case of the bottom-piston design, according to a preferred illustrative embodiment, having the supporting crossmembers 30 can be seen from FIGS. 5 and 6. As a result of the fluted and/or honeycombed groove arrangement 18 and 19, the press/heating platen 14 acquires a two-dimensional deformation, a high spherical flexibility, and four supporting bodies 29 on the supporting crossmembers 30 corresponding respectively to three hydraulic actuators 7, 8 and 9 in the case of a conventional bottom or top-piston version. Despite this high flexibility (longitudinally and transversely), larger support spacings e and hence a smaller number of hydraulic actuators 7, 8 and 9 can be employed. Consequently, the production costs of the entire press system can be considerably reduced, and up to four supporting bodies 29 are responsive to each actuator. As a result of the geometric shaping of these grooves 18 and 19, the high elastic deformability within the permissible stresses of both normal structural steels and higher-alloyed hardenable materials is obtained. Further, as a result of such one-sided use of the fluted and honeycombed grooves 18 and 19 on the supporting side of the press/heating platen 14, an eccentric arrangement of the heating bores in the direction of the pressing stock side can be advantageously exploited.

As a matter of principle, the teaching according to the invention of a fluted or honeycombed profile 18 and 19 can not only be used specifically in a bottom-piston design having supporting crossmembers 30, but is also applicable to a top-piston press and a bottom-piston design, having far larger support spacings, which, as already mentioned, requires thicker press/heating platens 14.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A press/heating platen for a continuously operating press in the production of pressed boards, said press/heating platen comprising:

fluted grooves formed longitudinal to a pressing zone and between rows of actuators of the continuously operating press; and honeycombed grooves formed transverse to the pressing zone between the actuator rows wherein a depth of said fluted and said honeycombed grooves is about 25% of a thickness of said press/heating platen;

wherein a width of said fluted and said honeycombed grooves is approximately equal to said thickness of said press/heating platen; and a compound curve in said fluted and said honeycombed grooves is approximately 50–100% of said depth of said fluted and said honeycombed grooves.

2. A press/heating platen as claimed in claim 1, wherein said fluted and said honeycombed grooves are molded into said press/heating platen.

3. The press/heating platen as claimed in claim 2, wherein said honeycombed grooves are molded into the press/heating platens over the entire pressing zone.

4. The press/heating platen for as claimed in claim 2, wherein said honeycombed grooves are molded only at selected locations of the pressing zone.

5. The press/heating platen as claimed in claim 1, wherein two spaced apart honeycombed grooves are formed between the actuator rows in direct proximity to supporting elements.

6. A press/heating platen for a continuously operating press in the production of pressed boards, said press/heating platen comprising:

fluted grooves formed longitudinal to a pressing zone and between rows of actuators of the continuously operating press; and honeycombed grooves formed transverse to the pressing zone between the actuator rows;

wherein two spaced apart honeycombed grooves are formed between the actuator rows in direct proximity to supporting elements; and wherein a plurality of heating duct bores are formed in said press/heating platen and eccentrically arranged therein such that a distance from a rolling side of the heating platen is approximately 20–35% of said thickness.

7. A continously operating press for the production of pressed boards comprising:

flexible endless steel belts;

driving drums and reversing drums;

an upper press beam and a lower press beam;

an upper press/heating platen and a lower press/heating platen;

rolling supporting elements each having a longitudinal axis; and a plurality of actuators disposed in rows longitudinally and transversely to a longitudinal axis of the press;

wherein the flexible endless steel belts transmit pressing pressure, pull material to be pressed through the press, are guided via the driving drums and reversing drums around the upper and lower press beams and are supported with an adjustable press nip against the press/heating platens on the press beams via the rolling supporting elements which accompany their revolution and are guided with their axes transverse to a running direction of the belt, at least one of the lower and upper press/heating platens, for the setting of the press nip, being vertically adjustable by a plurality of actuators disposed in rows longitudinally and transversely to a longitudinal axis of the press, and wherein said press/heating platens comprise:

fluted grooves formed longitudinal to a pressing zone between the actuator rows; and honeycombed grooves formed transverse to the pressing zone between the actuator rows.

8. The continuously operating press as claimed in claim 7, wherein the actuators include a plurality of pressure pistons, each pressure piston providing a multi-surface support for said press/heating platen, and wherein a spherical deformation of the press/heating platen over its length and width can be introduced by applying a pressure to said multi-surface support by said pistons and varying said pressure across the width and length of said press/heating platen.

9. The continuously operating press as claimed in claim 8, wherein two to four supporting bodies are provided for each pressure piston.

10. The continuously operating press as claimed in claim 9, wherein a longitudinal distance of the supporting bodies from one another corresponds to the support spacing of web plates.

11. The continuously operating press as claimed in claim 8, wherein the individual supporting bodies of the pressure pistons are disposed on supporting crossmembers between the pressure pistons and the press/heating platen.

12. A continuously operating press as claimed in claim 7, wherein said fluted and said honeycombed grooves are molded into said press/heating platens.

13. The continuously operating press as claimed in claim 12, in said honeycombed grooves are molded into the press/heating platens over the entire pressing zone.

14. The continuously operating press as claimed in claim 12, wherein said honeycombed grooves are molded only at selected locations of the pressing zone.

15. The continuously operating press as claimed in claim 7, wherein two spaced apart honeycombed grooves are formed between the actuator rows in direct proximity to supporting elements.

16. The continuously operating press as claimed in claim 15, wherein a plurality of heating duct bores are formed in said press/heating platens and eccentrically arranged therein such that a distance from a rolling side of a respective one of the press/heating platens is approximately 20–35% of said thickness.

17. The continuously operating press as claimed in claim 7, wherein a depth of said fluted and said honeycombed grooves is about 25% of a thickness of one of said press/heating platens; a width of said fluted and said honeycombed grooves is approximately equal to said thickness of said one of said press/heating platens; and a compound curve in said fluted and said honeycombed grooves is approximately 50–100% of said depth of said fluted and said honeycombed grooves.

* * * * *